United States Patent [19]

Balzer

[11] 4,251,705

[45] Feb. 17, 1981

[54] INDUCTOR FOR HARDENING GEAR TEETH

[75] Inventor: Norbert R. Balzer, Parma, Ohio

[73] Assignee: Park-Ohio Industries, Inc., Cleveland, Ohio

[21] Appl. No.: 38,494

[22] Filed: May 14, 1979

[51] Int. Cl.[3] ..... H05B 6/14; H05B 6/42

[52] U.S. Cl. ..... 219/10.59; 219/10.49 R; 219/10.79; 266/129; 266/125; 148/147

[58] Field of Search ..... 219/10.59, 10.79, 10.57, 219/10.43, 10.49 R; 266/125, 126, 124, 129; 148/147, 150, 152, 154

[56] References Cited

U.S. PATENT DOCUMENTS

| | | | |
|---|---|---|---|
| 2,810,054 | 10/1957 | Jones | 219/10.59 |
| 3,185,808 | 5/1965 | Sorensen et al. | 219/10.59 X |
| 3,403,241 | 9/1968 | Kauffman | 219/10.59 |
| 3,466,023 | 9/1969 | Cunningham et al. | 219/10.59 X |

FOREIGN PATENT DOCUMENTS

| | | | |
|---|---|---|---|
| 761760 | 11/1956 | United Kingdom | 219/10.59 |
| 775463 | 5/1957 | United Kingdom | 219/10.59 |
| 1162113 | 8/1969 | United Kingdom | 219/10.59 |

*Primary Examiner*—B. A. Reynolds
*Assistant Examiner*—Philip H. Leung
*Attorney, Agent, or Firm*—Meyer, Tilberry & Body

[57] ABSTRACT

An inductor for heating the circumferentially opposed working surfaces and the root surface between adjacent gear teeth includes a nose portion received between the adjacent teeth and having a profile corresponding to that of the working and root surfaces. The nose portion is comprised of a flux concentrator having axially opposite ends and radially inner and outer ends, a generally V-shaped conductor plate having ends attached to the radial inner end of the concentrator and defining a coolant passageway therewith, and tubular conductors at the axially opposite ends of the flux concentrator and plate to provide for the circulation of coolant through the nose portion. A portion of the tubular conductor extends axially adjacent the radially outer side of the flux concentrator.

3 Claims, 6 Drawing Figures

INDUCTOR FOR HARDENING GEAR TEETH

BACKGROUND OF THE INVENTION

The present invention relates to the art of induction heating and, more particularly, to an inductor for heating the working and root surfaces between adjacent gear teeth.

The present invention is directed to an improved inductor for use in connection with the hardening of the circumferentially opposed working surfaces of adjacent gear teeth and the radially outwardly facing root surface between the teeth. It is of course well known in the induction hardening field to harden the working surfaces of adjacent gear teeth by inductively heating the surfaces and immediately thereafter quenching the surfaces. It is further well known to achieve such induction heating by means of a U-shaped inductor comprised of an electrical conductor having parallel legs extending radially of the gear teeth in axial spaced relationship and a nose or bridging portion therebetween which is received between the adjacent teeth. Such a nose or bridging portion has a profile corresponding generally with that of the working and root surface between the adjacent teeth. The inductor is energized by a suitable power source, and the gear and inductor are generally relatively displaced axially to progressively move the inductor axially between the adjacent teeth. When the inductor passes through the space between the teeth, the circumferentially opposed working surfaces and the root surface therebteween are progressively heated, and by providing a quenching arrangement adjacent the trailing end of the inductor, the heated working and root surfaces are immediately quench hardened.

Such inductors heretofore provided for heating the working and root surfaces between adjacent teeth of a gear during a quench hardening operation have not provided satisfactory results with respect to achieving a desired uniformity of the depth of the heat pattern along the circumferentially opposed working surfaces and through the root area between the teeth. In this respect, previous inductor constructions have resulted in overheating the radially outer ends of the teeth as a result of the time required for the nose portion to achieve a desired depth of heating pattern in the root portion between adjacent teeth. Overheating of the radially outer ends of the working surfaces between adjacent gear teeth is undesirable in that the heating patterns on circumferentially opposite sides of the same gear tooth at the radially outer end thereof overlap one another. Since such overlap occurs on one side of a given tooth following the quench hardening of the working surface on the other side of the given tooth, the subsequent heating of the one side causes tempering or annealing of the previously hardened working surface adjacent the outermost portion of the gear tooth which decreases its hardness. While such overlap can be avoided by increasing the scanning speed, the latter results in an undesirable depth of the heating pattern in the root area between adjacent gear teeth. Since a uniform depth of the heating pattern and thus the hardened surface is desired throughout the working and root surfaces between adjacent teeth, the latter procedure does not solve the problem.

One previous effort to solve the foregoing problem is disclosed in U.S. Pat. No. 3,185,808 to Sorensen et al wherein one leg of a U-shaped inductor is provided with a copper block radially outwardly of the nose portion of the inductor. The copper block controls current flow through the inductor so as to limit the heating effect of the inductor near the radially outermost portions of the gear teeth as the inductor is moved axially between the teeth. While the latter structural arrangement does alleviate the problem to some extent, proper adjustment of the low resistance copper block relative to the nose is necessary to achieve the desired control of the heating effect, and such adjustment is a time consuming operation and requires testing to be sure that a given adjustment provides the desired control with respect to gear teeth to be hardened. Moreover, such a structural arrangement controls the heating effect so that the radially outer portions of the working surfaces of adjacent teeth are not overheated in response to a scanning speed which enables the desired heating in the root area between adjacent teeth. Accordingly, the scanning speed is the lower speed required to achieve the desired heating of the root area with control of current flow to prevent overheating of the radially outer surface areas of the teeth at the lower speed. Thus, the scanning speed is not optimized and this results in increasing the time required to inductively heat and harden all of the teeth on the outer periphery of a given gear. This, of course, results in a reduction in production rate.

SUMMARY OF THE INVENTION

In accordance with the present invention, an improved inductor structure is provided which enables achieving a more uniform depth of the heating pattern along the circumferentially opposed working surfaces and root surface between adjacent gear teeth at a higher scanning speed than heretofore possible, and without either underheating or overlap in the heating patterns on the circumferentially opposite sides of the same tooth. More particularly, these advantages are achieved in accordance with the present invention by providing a tubular inductor structure enabling the flow of coolant through the nose portion of the inductor, in combination with a flux concentrator and conductor arrangement defining the nose portion of the inductor and providing current concentration in that portion of the inductor magnetically coupled with the root portion between adjacent teeth. The inductor structure enables achieving a desired depth of heat pattern along the circumferentially opposed working surfaces of adjacent teeth and the root surface therebetween at a high scanning speed which heretofore would enable a desired heating pattern at the outer ends of the teeth without overlap but would not enable achieving the desired heating pattern in the root area between adjacent teeth. Moreover, the scanning speed enabled by the inductor of the present invention is higher than that which heretofore would enable a desired heating pattern by controlling current flow and thus the heating effect in the radially outer portions of adjacent gear teeth. The tubular construction of the inductor according to the present invention advantageously enables the dissipation of heat generated by current flow through the conductor portion of the inductor, thus enabling the high current concentration in the portion of the inductor in the root area to be achieved without damage to the inductor or shortening the life thereof.

It is accordingly an outstanding object of the present invention to provide an improved inductor structure for use in connection with inductively heating and quench hardening the circumferentially opposed working surfaces of adjacent gear teeth and the root surface therebetween.

Another object is the provision of an inductor of the foregoing character which enables obtaining a uniform depth of heat pattern radially inwardly along the opposed working surfaces and through the root surface therebetween.

A further object is the provision of an inductor of the foregoing character which enables the desired depth and uniformity of the heating pattern to be achieved at a higher scanning speed than heretofore possible.

Still another object is the provision of an inductor of the foregoing character which is of tubular construction and includes a flux concentrator and conductor structure defining a nose portion having a coolant passage therethrough and which construction enables achieving a uniform depth of heating along the working surfaces and root surface at a higher scanning rate than heretofore possible.

Yet a further object is the provision of an inductor of the foregoing character which enables increasing the production rate with regard to heating and hardening gear teeth by a scanning operation in which the inductor is sequentially displaced between adjacent teeth extending about the periphery of the gear.

Still another object is the provision of an improved inductor of the foregoing character which is structurally simple and economical to produce and use and which is efficient in operation.

BRIEF DESCRIPTION OF THE DRAWINGS

The foregoing objects, and others, will in part be obvious and in part pointed out more fully hereinafter in conjunction with the written description of a preferred embodiment of the invention shown in the accompanying drawings in which.

DESCRIPTION OF THE PREFERRED EMBODIMENT

Figure 1:
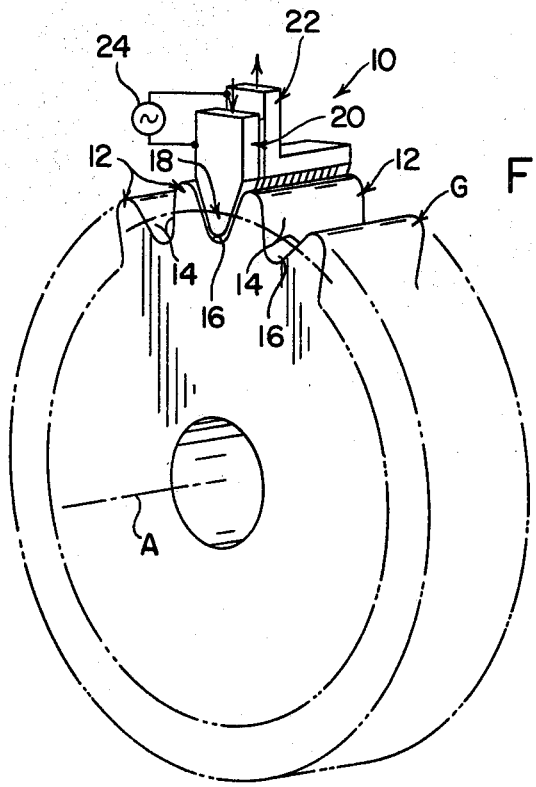
FIG. 1 is a perspective view, partially schematic, of an inductor in accordance with the present invention shown positioned between adjacent teeth of a gear.
Figure 2:
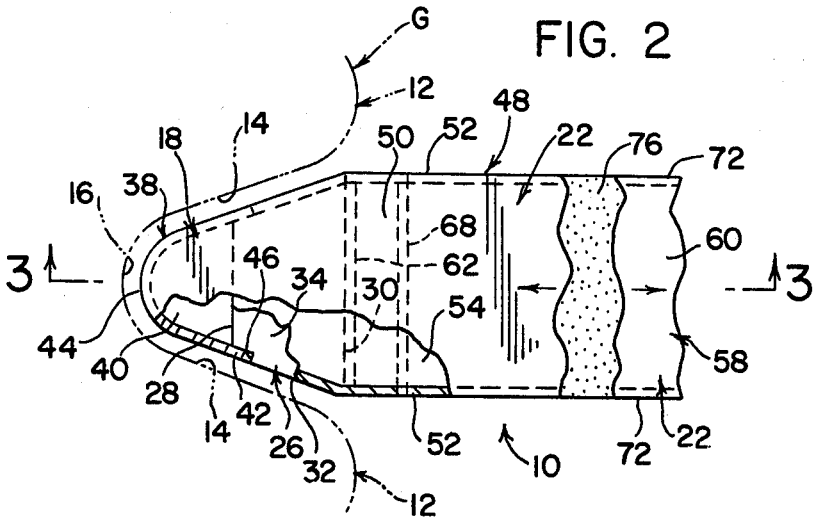
FIG. 2 is a plan view of an inductor constructed in accordance with the present invention.

Referring now in greater detail to the drawings, wherein the showings are for the purpose of illustrating a preferred embodiment of the invention only and not for the purpose of limiting the invention, FIG. 1 illustrates an inductor 10 according to the present invention associated with a gear G having an axis A and a plurality of gear teeth 12 extending about the periphery thereof. It will be appreciated of course that adjacent ones of the gear teeth 12 have circumferentially opposed working surfaces 14 which extend axially between the opposite sides of gear G. It will be further appreciated that the adjacent gear teeth have a root surface 16 therebetween which extends axially between the opposite sides of the gear and faces radially outwardly thereof.

As will be described in greater detail hereinafter, inductor 10 has a nose portion 18 having an outer surface profile generally corresponding to the profile defined by the opposed working surfaces 14 and root surface 16 therebetween, whereby the latter surfaces are adapted to be inductively heated by energizing the inductor and positioning the latter in magnetically coupled relationship with the gear teeth surfaces. Preferably, the induction heating is progressive from one axial side of the gear to the other and is achieved by supporting the inductor and gear for relative axial displacement and thus scanning displacement between the inductor and gear teeth surfaces. Induction heating equipment for supporting the inductor and gear achieving such scanning displacement is well known in the art and, accordingly, is not shown. Additionally, it will be appreciated that the inductively heated surfaces of the gear teeth may be immediately quenched such as by a water spray to harden the teeth surfaces. Following such heating and hardening operation, the inductor and gear are axially displaced back to their initial positions after which the gear is indexed circumferentially to align the inductor with the space between another pair of teeth 12, and the heating and quenching operation is then repeated. This procedure of course is continued until the working surfaces of all of the teeth 12 on the outer periphery of gear G are quench hardened. Again, equipment for such a quenching spray and for indexing the gear are well known in the art and, accordingly, are not illustrated herein.

Inductor 10 is a tubular inductor having terminal ends 20 and 22 connectable across a suitable source of alternating current 24 for energizing the inductor and connectable to a source of coolant such as water, not illustrated, to facilitate circulation of coolant through the inductor as indicated by the arrows associated with terminal ends 20 and 22 in FIG. 1. The construction of inductor 10 is shown in detail in FIGS. 2–6 of the drawing and, with reference to the latter Figures, it will be seen that nose portion 18 of the inductor is defined in part by a flux concentrator 26 which, in the embodiment illustrated, is comprised of a group or stack of iron plates. Flux concentrator 26 has radially inner and outer ends 28 and 30, respectively, with respect to gear teeth 12 and gear axis A, which surfaces are parallel to one another and extend axially with respect to the gear teeth. Further, the flux concentrator has circumferentially opposite sides 32 extending axially with respect to the gear teeth and corresponding generally in profile with the profile of the corresponding portion of working surface 14 of the adjacent gear tooth 12 when the nose portion is disposed between teeth 12. Still further, flux concentrator 26 has axially opposite ends 34 and 36 which, in the orientation of the inductor shown in FIGS. 3–6, are respectively the upper end and lower ends of the flux concentrator.

Inductor 10 is further comprised of conductor portions constructed and associated with flux concentrator 26 to provide the tubular construction for flow of coolant through the inductor and to complete nose portion 18 with respect to providing the latter with the profile corresponding generally to that of working surfaces 14 and root surface 16 between gear teeth 12. In this respect, a generally V-shaped plate 38 of conductive material such as copper is brazed or otherwise attached to concentrator 26 to provide an axially extending coolant passageway 40 through nose portion 18. More particularly, plate 38 provides an axially extending V-shaped wall having radially outer ends 42 each adjacent one of the sides 32 of flux concentrator 26, and an apex portion 44 spaced radially inwardly from inner end 28 of flux concentrator. The outer surface of ends 42 of plate 38 coincide with the outer surface of the corresponding side 32 of the flux concentrator, and these outer surfaces together with the outer surface of apex portion 44 provide for nose portion 18 of the inductor to have a profile corresponding to that of opposed working surfaces 14 and root surface 16 of adjacent gear teeth 12. The radially outer ends 42 of plate 38 can be attached to flux concentrator 26 in any suitable manner to achieve the desired coincidence of the outer surfaces therebetween and, in the embodiment disclosed, this is achieved by providing axially and radially extending recesses 46 in flux concentrator 26 to receive ends 42.

The conductor portions of inductor 10 further include a tubular conductor 48 having a radially outer end providing terminal end 20 of the inductor as described hereinabove, and having an opposite or radially inner end connected to the upper end of plate 38. In this respect, in the embodiment disclosed, tubular conductor 48 has a top wall 50, circumferentially opposite side walls 52, and a bottom wall 54. The radially inner ends of walls 50, 52 and 54 are contoured to conform with the profile of flux concentrator 26 and conductor plate 38, and side walls 52 extend about the radially inner end of top wall 50 to provide a depending skirt portion 56 which is axially aligned with and suitably connected such as by brazing to conductor plate 38. Bottom wall 54 of conductor 48 terminates at the radially inner end 28 of the flux concentrator to provide fluid flow communication between tubular conductor 48 and coolant passageway 40.

The conductor portion of inductor 10 further includes a tubular conductor 58 having a radially outer end providing terminal end 22 of the inductor as described hereinabove, and having an opposite or radially inner end which underlies flux concentrator 26 and is attached to the lower end of conductor plate 38. Additionally, conductor 58 has an intermediate portion extending axially of the flux concentrator along the radially outer end 30 thereof. In the embodiment shown, tubular conductor 58 is comprised of an upper wall having a portion 60 extending radially inwardly beneath bottom wall 54 of conductor 48, a portion 62 extending downwardly along the radially outer end 30 of flux concentrator 26, and a portion 64 extending radially inwardly beneath the flux concentrator. Conductor 58 further includes a bottom wall having portions 66, 68 and 70 spaced from and parallel respectively to portions 60, 62 and 64 of the top wall, and circumferentially opposite side walls 72 closing the top and bottom walls between the opposite ends thereof. Portion 64 of the top wall and portion 70 of the bottom wall are contoured to provide the desired profile for nose portion 18 of the inductor, and the corresponding portions of the side walls 72 provide an upwardly directed skirt 74 aligned with and suitably connected such as by brazing to the bottom edge of conductor plate 38. It will be noted that portion 64 of the top wall of conductor 58 terminates adjacent the radially inner end of the flux concentrator to provide for flow communication Between tubular conductor 58 and coolant passageway 40. Suitable insulation 76 is provided between the radially outer ends of tubular conductors 48 and 58 to electrically insulate the latter ends, and it will be noted that the radially outer ends of tubular conductors 48 and 58 and the intermediate portion of the latter conductor have a circumferential width corresponding to that of the radially outer end 30 of flux concentrator 26.

Figure 3:
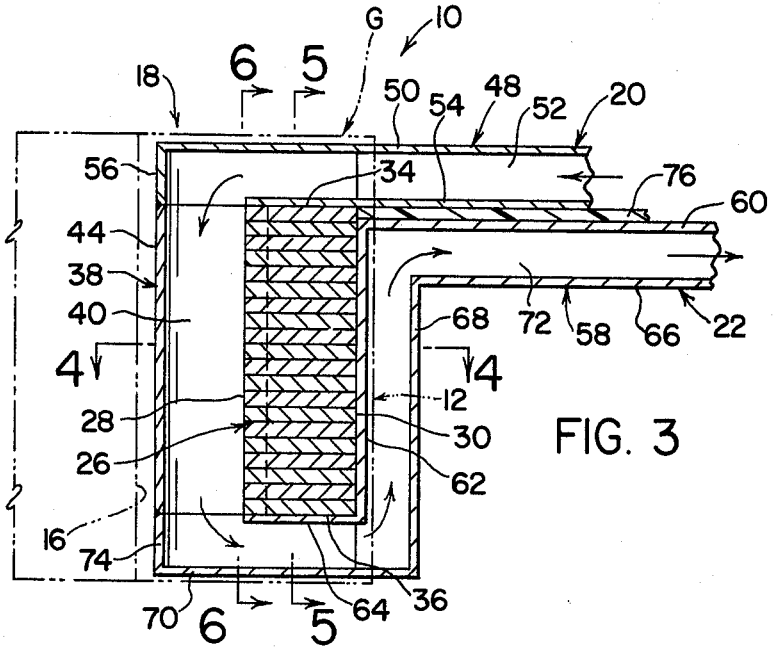
FIG. 3 is a sectional elevation view of the inductor taken along line 3—3 in FIG. 2.
Figure 4:
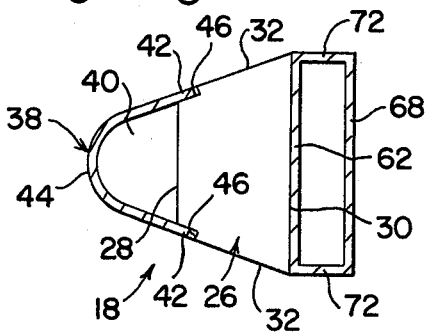
FIG. 4 is a sectional plan view of the inductor taken along line 4—4 in FIG. 3.
Figure 5:
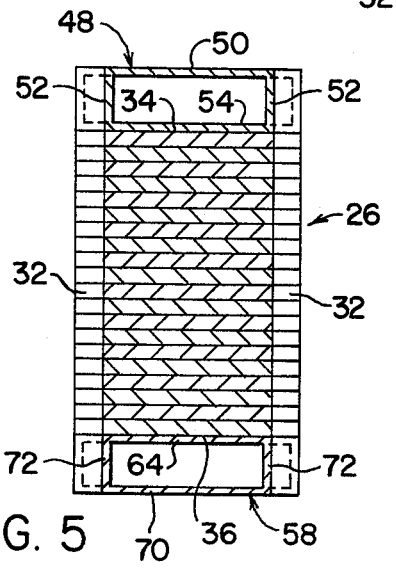
FIG. 5 is a sectional elevation view of the inductor taken along line 5—5 in FIG. 3; and, FIG. 6 is a sectional elevation view of the inductor taken along line 6—6 in FIG. 3.
Figure 6:
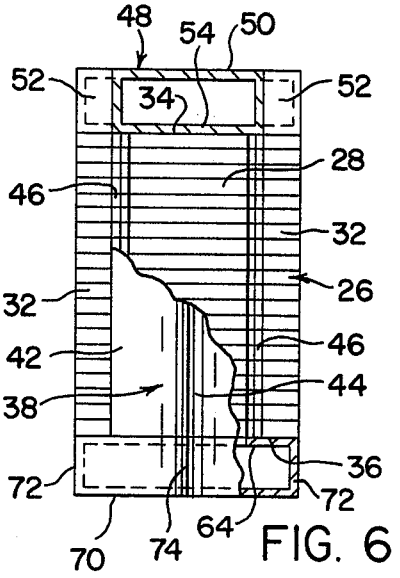

Preferably, terminal end 20 of tubular conductor 48 is connected to the coolant circulating system to define the coolant inlet for flow through the inductor as indicated by the direction of the arrows in FIG. 3, whereby terminal end 22 of tubular conductor 58 would be connected to the return of the coolant system. This is preferred since tubular conductor 48 on the embodiment shown provides the shortest path for coolant flow to nose portion 18 of the inductor, thus providing coolant to the nose portion at a lower temperature than would be possible if flow through the inductor were reversed.

In use, it will be appreciated that inductor 10 is energized and that the inductor and gear G are relatively axially displaced for the inductor to move axially between adjacent gear teeth 12 in magnetically coupled relationship with the opposed working surfaces 14 and root surface 16 between the teeth to inductively heat the surfaces. It will be further appreciated that coolant is circulated through the inductor to cool the conductor portion and flux concentrator during the induction heating operation. Upon energization of the inductor, flux concentrator 26 advantageously concentrates current in plate 38 and thus the magnetic flux in the field between the plate and gear G. This enables achieving a more uniform depth of the heat pattern along the entire radial extent of working surfaces 14 and circumferentially along root surface 16 than heretofore possible. In this respect, the concentration of current in the V-shaped conductor plate 38 enables achieving a desired depth of heat pattern in the corresponding tooth surface portions at a scanning rate which provides for achieving the desired depth of heat pattern in radially outer portions of working surfaces 14 without overheating the radially outer ends of the teeth.

While it is preferred to provide for the intermediate portion of tubular conductor 58 to extend along the radially outer end of flux concentrator 26 to enable supplemental cooling of the latter by the coolant flowing to the coolant system return, it will be appreciated that tubular conductor 58 could be associated with the lower end of nose portion 18 of the inductor in a manner structurally similar to that of tubular conductor 48, whereby tubular conductor 58 would extend radially outwardly directly from the lower end of flux concentrator 26. Moreover, it will be appreciated that many modifications of the specific structures of the component parts of the inductor herein illustrated and described will be obvious and can be made without departing from the principles of the present invention. For example, the flux concentrator can be defined other than by a stack of laminations of iron and in this respect, for example, could be constructed of a molded composition of powdered iron. Likewise, it will be appreciated that conductor plate 38 could be extended axially and directly joined with top wall 50 of conductor 48 and bottom wall portion 70 of conductor 58 as opposed to being connected to the side walls and skirt portions of the latter conductors. Many fabrications of the conductor portions to provide a conductor plate in the nose portion of the inductor and coolant flow passageways through the inductor can readily be devised, as can structural arrangements for supporting the flux concentrator relative to the conductor portions to define the nose portion 18 of the inductor. Accordingly, since many embodiments of the invention can be made and since many changes can be made in the preferred embodiment herein illustrated and described, it is to be distinctly understood that the foregoing descriptive matter is to be interpreted merely as illustrative of the present invention and not as a limitation.

Having thus described the invention, it is claimed:

1. An inductor for inductively heating the circumferentially opposed working surfaces of adjacent gear teeth and the radially outwardly facing root surface therebetween, said inductor including flux concentrating means having circumferentially opposite sides, planar and parallel axially opposite ends and planar and parallel radially inner and outer ends, an axially extending generally V-shaped plate of conductive material having radially outer ends attached to said circumferentially opposite sides of said flux concentrating means and an apex spaced radially inwardly of and parallel to said inner end of said flux concentrating means, said circumferentially opposite sides of said flux concentrating means and said plate together providing a profile corresponding to the axial and radial profile of said working and root surfaces of said adjacent teeth, said plate and said radially inner end of said flux concentrating means providing an axially extending coolant passageway of uniform cross-section between said axially opposite ends of said flux concentrating means, said coolant passageway having axially opposite ends, a tubular conductor at each of said opposite ends of said coolant passageway, each said tubular conductor having an inner end in flow communication with the corresponding end of said coolant passageway and extending radially outwardly across the corresponding one of said axially opposite ends of said flux concentrating means, and each said tubular conductor having a terminal end connectable to a source of alternating current and to a source of coolant.

2. An inductor according to claim 1, wherein one of said tubular conductors has an intermediate portion between said inner and terminal ends thereof, said intermediate portion extending axially along said radially outer end of said flux concentrating means.

3. An inductor according to claim 2, wherein said intermediate portion of said tubular conductor has a circumferential width corresponding to that of said radially outer end of said flux concentrating means.

* * * * *